United States Patent [19]

Hayes et al.

[11] 4,141,549

[45] Feb. 27, 1979

[54] TENNIS RACKET

[76] Inventors: Thomas J. Hayes, 54-12 Kissena Blvd., Flushing, N.Y. 11355; William M. Reed, 229 East 81st St., New York, N.Y. 10028

[21] Appl. No.: 798,362

[22] Filed: May 19, 1977

[51] Int. Cl.[2] ..... A63B 69/38

[52] U.S. Cl. ..... 273/29 A; 273/73 D

[58] Field of Search ..... 273/29 A, 73 R, 73 C, 273/73 D, 73 H

[56] References Cited

U.S. PATENT DOCUMENTS

| | | | |
|---|---|---|---|
| 1,502,845 | 7/1924 | Blache | 273/73 D |
| 3,820,785 | 6/1974 | Occhipinti | 273/73 R X |
| 3,968,966 | 7/1976 | D'Aquanni | 273/73 D |
| 4,049,269 | 9/1977 | Blackburne | 273/73 D |
| 4,076,239 | 2/1978 | Hall | 273/29 A |
| 4,090,707 | 5/1978 | Saar | 273/29 A |

FOREIGN PATENT DOCUMENTS

| | | | |
|---|---|---|---|
| 2307942 | 9/1973 | Fed. Rep. of Germany | 273/73 D |
| 2453029 | 7/1975 | Fed. Rep. of Germany | 273/29 A |
| 1212195 | 10/1959 | France | 273/73 D |
| 1398833 | 4/1965 | France | 273/73 D |
| 2255 | 5/1881 | United Kingdom | 273/73 D |

*Primary Examiner*—Richard J. Apley
*Attorney, Agent, or Firm*—Natter & Natter

[57] ABSTRACT

A tennis racket has a frame member forming a head portion having duplicate strung ball striking matrices, each matrix being substantially coplanar with a respective front and rear face of the frame member. The matrices are formed with a plurality of intersecting string lengths, each being threaded through an aperture extending between the front and rear face of the frame member. In an alternate embodiment each string length traverses a respective front or rear face and then is passed through a radially directed aperture connecting an outer margin of the frame with an inner margin. A signal device is attachable to the matrices for emitting an audible response upon ball impact within a prescribed locus on the matrix.

5 Claims, 12 Drawing Figures

FIG. 1
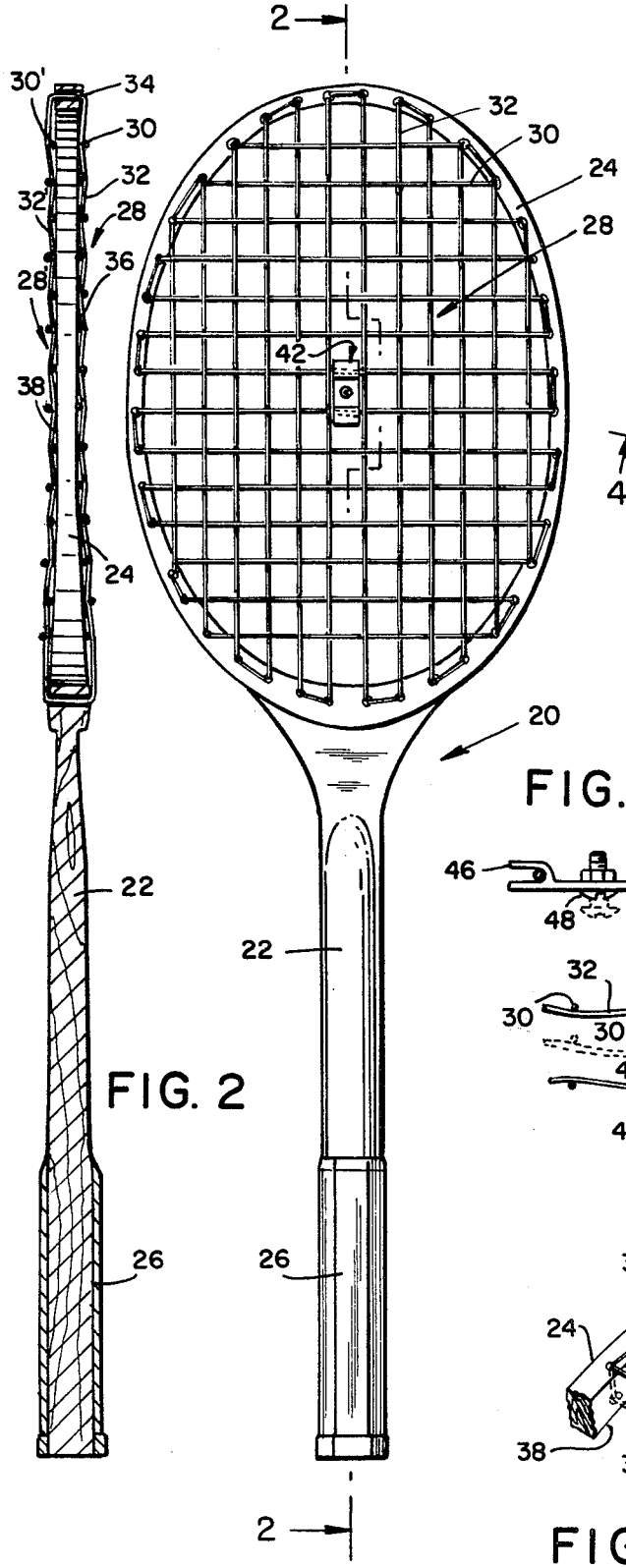
FIG. 2
FIG. 3
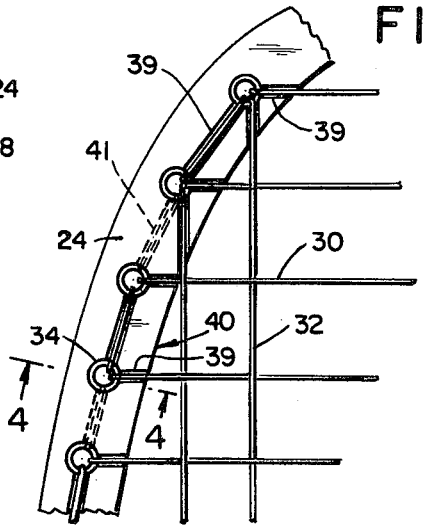
FIG. 4
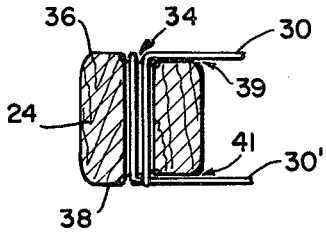
FIG. 6
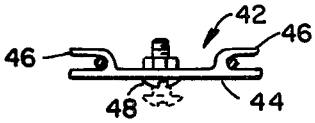
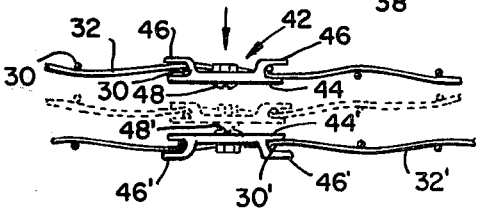
FIG. 7
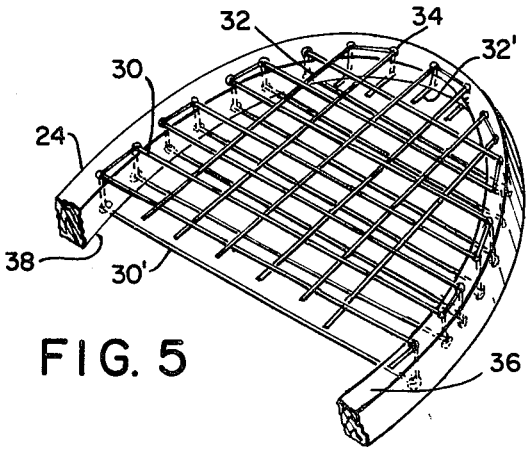
FIG. 5

FIG. 8
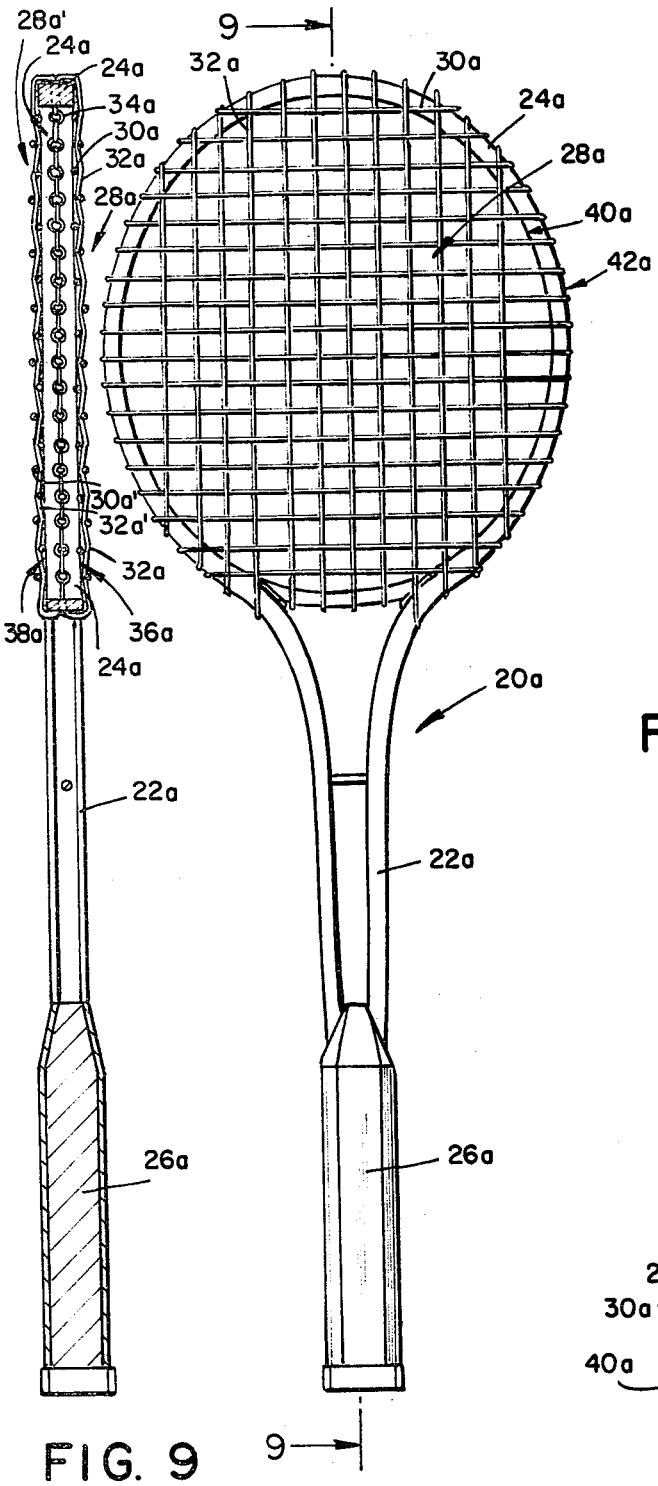
FIG. 9
FIG. 10
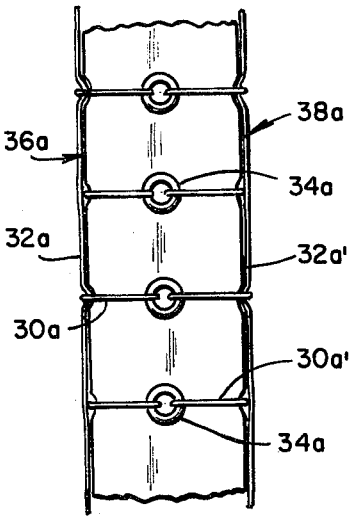
FIG. 11
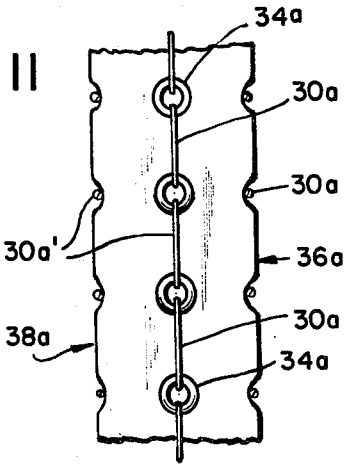
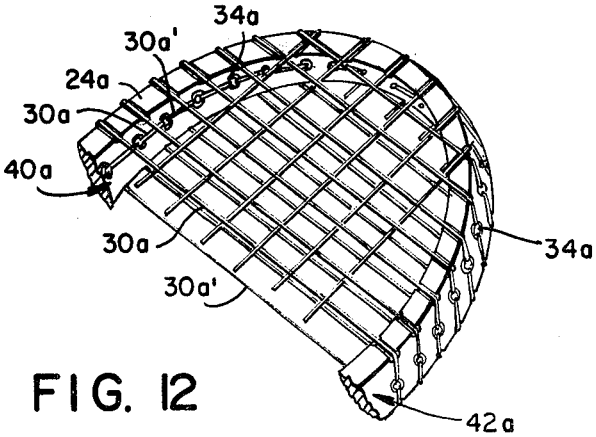
FIG. 12

TENNIS RACKET

BACKGROUND OF THE INVENTION

1. Field of the Invention

This invention relates generally to sports apparatus and especially to a strung racket for propelling a projectile as typically used for playing tennis, squash, racquet ball, badminton, and similar activities.

2. Description of the Prior Art

Conventional game rackets such as tennis rackets had typically been strung with each string length threaded through a centered opening within an inner margin of a racket head frame. The resultant grid of intersecting strings defined a single plane centered within the frame and offset from both a rear and front surface of the frame.

A disadvantage of this prior racket construction is that, upon ball impact with the string grid in an area adjacent the frame or an off-center hit, resulted in ball contact with the frame and erratic deflection causing the ball to rebound in an unpredictable flight path. Additionally, off-center hits induced a torque which frequently caused the racket head to twist and further misdirect the trajectory of the ball.

The present invention overcomes these shortcomings by providing a game racket having a ball impact string matrix which is substantially coplanar to a respective front and rear face of a frame. As a result, the ball will squarely contact a planar surface regardless of whether impact is directly in a central region of the string matrix of is in an area adjacent to or overlying a portion of the frame. It should therefore be apparent that the racket of the instant invention will thus expand the effective ball impact zone without enlarging the racket head. The racket will also have improved balance for better ball control.

Another problem of the prior art rackets is that a single string grid was subject to twice the wear. Not only was there a more rapid deterioration of the strings with usage, but repeated ball impact resulted in a more rapid loss of string tension. In contrast, the duplicate ball striking matrices of the present invention effectively increases the useful string life by permitting a distribution of ball impact upon each of two different impact string matrices. The racket of this invention also provides more reserve power upon stroking the ball in that both matrices can concurrently be deflected and will act in unison to provide an increased rebound force.

Another advantage of this invention concerns its adaptation for teaching purposes. In order to properly learn how to play tennis the beginner is instructed to watch the ball and not the racket. The ball should preferably be struck with the central high response region of the string grid or "sweet spot." It is difficult for the beginning player to diagnose improper strokes in that ball contact with the string grid cannot be observed. The signal device thus provides an audible indication to emphasize the point of contact and make the player aware of off-center hits.

SUMMARY OF THE INVENTION

In compendium, this invention concerns a game racket such as a tennis racket having a head portion and depending stem forming a handle for manipulating the racket. The head portion includes a frame member forming an included area which is spanned by a string matrix adaptable for striking a game projectile. The frame member is provided with a plurality of apertures through which a flexible filament, strand or string is continuously threaded in seriatim to form a grid or matrix. The string matrix is formed with parallel string lengths extending in perpendicular directions and terminating in apertures passing through the frame member.

The racket head portion is double strung so as to form coincident string matrices on each of two opposed front and rear racket faces of the frame member. The matrices so formed are substantially coplanar with the corresponding surfaces of the frame member and effectively enlarge the ball impact zone without increasing the size or weight of the racket head.

A signal device having companion elements for sound emission are each attachable in registration to respective string matrices. Deflection of either or both matrices upon impact with a game projectile within a defined locus on the matrix will effectuate contact of the sound emission elements and provide an audible indication that the projectile has impacted within the locus and that the requisite impact force has been applied thereto.

From the foregoing summary, it will be appreciated that it is an object of the present invention to provide a tennis racket of the general character described which is not subject to the disadvantages aforementioned.

A further object of the present invention is to provide a tennis racket having a head portion formed by a frame member which supports a string matrix substantially coplanar with at least one face of the frame member for effectively enlarging the ball impact zone.

Another object of the present invention is to provide a tennis racket having duplicate matrices on opposed sides of the frame member for increasing the available impact force of the racket head and further for maximizing the durable life span of the matrix.

Yet another object of the present invention is to provide a tennis racket of the general character described which is adaptable for use with a signal device to provide an audible indication in response to ball impact within a prescribed location on the matrix.

A still further object of the present invention is to provide a tennis racket of the general character described which is simple in construction, low in cost, reliable in use and well adapted for mass production fabrication techniques.

Other objects of the invention in part will be apparent and in part will be pointed out hereinafter.

With these ends in view, the invention finds embodiment in certain combinations of elements and arrangements of parts by which the objects aforementioned and certain other objects are hereinafter attained, all as fully described with reference to the accompanying drawings, and the scope of which is more particularly pointed out and indicated in the appended claims.

BRIEF DESCRIPTION OF THE DRAWINGS

In the accompanying drawings in which are shown some of the various possible exemplary embodiments of the invention:

FIG. 1 is a front elevational view of a tennis racket constructed in accordance with this invention and shows a racket frame member supporting a plurality of intersecting string lengths and including a signal device;

FIG. 2 is a sectional view taken substantially along line 2—2 of FIG. 1 and shows the duplicate stringing of the racket head;

FIG. 3 is an enlarged auxiliary view of a portion of the racket head and shows the placement of the string lengths in the apertures formed in the frame member;

FIG. 4 is a view taken substantially along line 4—4 of FIG. 3 and illustrates a section through the aperture in the frame member including the string lengths threaded therethrough;

FIG. 5 is a partial perspective view of the head portion of the tennis racket shown in FIG. 1 and illustrates, for clarity, only some of the string lengths which are substantially coplanar to opposed faces of the racket frame and overlying an inner margin of the frame;

FIG. 6 is an enlarged view of one of the components of the signal device and shows an adjustable contact element which can be extended as indicated by the broken line illustration for adjusting the spacing or gap between the two corresponding contact elements;

FIG. 7 is an enlarged isolated view which shows a portion of each of two matrices having a signal device attached with the broken line illustration indicating deflection of one of said matrices in response to ball impact in the direction of the arrow;

FIG. 8 is an elevational view of the tennis racket of this invention showing an alternate embodiment wherein a racket head is formed by a frame member having radial extending apertures for receiving a plurality of intersecting string lengths;

FIG. 9 is a sectional view taken substantially along line 9—9 of FIG. 8 and shows the duplicate stringing of the racket head;

FIG. 10 is an enlarged auxiliary view showing a partial portion of an outer margin of the frame member with several string lengths being shown threaded through respective radial apertures and passing within recessed areas around the frame member;

FIG. 11 is an enlarged auxiliary view showing a partial portion of an inner margin of the frame member and the threadable engagement of the string lengths through the radial apertures of the frame member; and FIG. 12 is a partial perspective view of the head portion of the tennis racket shown in FIG. 8 and illustrates, for clarity, only some of the string lengths.

DESCRIPTION OF THE PREFERRED EMBODIMENT

The reference numeral 20 denotes generally a tennis racket constructed in accordance with and embodying the invention. The racket 20 includes an elongated manipulating stem 22 supporting a racket head frame 24 at one end and having a hand grip 26 at the distal end. The racket frame 24 is generally oval or circular in shape and circumscribes an included area containing a projectile striking matrix 28, 28'.

As illustrated in FIG. 1, the matrix 28 is formed by a plurality of parallel transverse string lengths 30 and perpendicularly intersecting longitudinal string lengths 32 which define a grid pattern within the included area. A second coincident grid pattern having parallel transverse string lengths 30' and longitudinal string lengths 32' forms matrix 28'. It will be observed, however, particularly with reference to FIG. 3, that the racket frame 24 has been provided with a series of apertures 34 located approximately along the center line of the edge width. The apertures 34 are spaced apart a distance corresponding to the spacing between the parallel string lengths 30, 32. The apertures 34 project through the depth dimension of the racket frame 24 and consequently provide a passageway interconnecting a front surface 36 and a rear surface 38 of the racket frame 24. Each of the respective string lengths 30, 32 extends beyond an inner margin 40 of the racket frame 24 and is threaded through a corresponding aperture 34 as noted in FIGS. 3–5.

The stringing operation may be performed using a continuous length of racket string such as nylon, gut, or similar string materials and by beginning at one end and threading it through the respective apertures 34 between opposite sides of the racket frame 24. The string lengths at the extreme opposite ends of the frame member 24 can, however, be omitted as shown in FIG. 2. In a typical stringing procedure, one can, for instance, begin with the transverse string lengths 30 and threadably pass a beginning point of each string length 30 through the aperture 34 with entry into aperture 34 along the front surface 36 of the frame member 24. The beginning point is then passed through the next consecutive aperture 34 along the rear surface 38 of the racket frame 24 and brought back to the front surface 36 and then across the included area to thus form another transverse string length 30. The same process is followed for the transverse string lengths 32. Upon completion of the stringing of one racket surface, e.g. the formation of the matrix 28, coplanar to the front surface 36, the same operation is repeated on the rear racket surface 38. In this manner, the two or duplicate ball striking matrices 28, 28' are thus constructed. Each of the respective matrices 28, 28' will be substantially coplanar to the respective front and rear racket surfaces 36, 38. Furthermore, those portions of the string lengths 30, 30', 32, 32' overlying the respective front and rear surfaces 36, 38 may be recessed in a corresponding groove 39, 41 to provide a flush surface for impact with a ball and further will prevent abrasion of the strings, if the racket contacts the tennis court surface. Additionally, the apertures 34 can be lined with a nylon bushing or similar material to reduce frictional contact and string wear. The beginning and endpoint of the string lengths 30, 32 can be knotted or otherwise secured to the front of the racket frame 28 to prevent loosening or unravelling. It should be further noted that the above described stringing procedure can be varied such as by stringing both matrices 28, 28' simultaneously.

A signal device 42 as shown in FIG. 6. The signal device 42 consists of a plate 44 having a string engaging a hook 46 for securing the device to two consecutively spaced string lengths 30. The plate 44 can thus be resiliently held within the string matrix 28. The plate 44 contains a noise emitting element 48 which is shown typically as having a half-rounded metallic head. In FIG. 7 each of two companion plates 44 and 44' are installed to respective matrices 28, 28' coplanar with the front and rear racket faces 36, 38. The plates 44, 44' have corresponding hooks 46, 46' for engaging consecutive strings lengths 30, 30' and elements 48, 48' for emitting a sound. When either of the matrices 28, 28' impacts with a projectile the corresponding matrix will deflect causing the noise emitting elements 48, 48' to contact each other to thus signal the player that impact has been made within a particular region or "sweet spot." The contact elements 48, 48' can also be adjusted to vary their distance between the matrices 28, 28'. This is accomplished by threadably extending either of the contact elements 48, 48' as illustrated by the broken line embodiment shown in FIG. 6. As these elements 48, 48' are brought closer together, the requisite impact force required to activate the signal device 42 will also be diminished. Thus, the device 42 can be adjusted to accommodate the individual player's power.

In a variant form of the invention illustrated in FIGS. 8 through 12 and wherein like reference numerals denote like components previously described, however bearing the suffix "a," the numeral 20*a* denotes generally a tennis racket embodying the invention. The racket 20*a* includes an open throat stem 22*a* having a generally circular racket head frame 24*a* at one end and a hand grip 26*a* at the other end.

The racket frame 24*a* supports two matrices 28*a*, 28*a*'. The matrix 28*a* is formed, as noted in FIG. 8, by a plurality of intersecting transverse 30*a* and longitudinal 32*a* string lengths. A similar set of intersecting string lengths 30*a*', 32*a*' form the second matrix 28*a*' in a manner as previously described with regard to the other embodiment. The duplicate ball striking matrices 28*a*, 28*a*' as shown in FIG. 9 are coincident with a respective front racket face 36*a* and a rear racket face 38*a*. It should be noted, however, that in this modified construction the frame member 24*a* is provided with a series of radially directed apertures 34*a* which connect an inner marginal surface 40*a* with an outer marginal surface 42*a*. Furthermore, each of the string lengths 30*a*, 32*a* consequently extends completely across the width of the frame member 24*a* along the respective front faces 36*a* and is recessed in grooves to provide substantial coplanarity with the respective face 36*a* as noted in FIGS. 10 and 11.

The procedure for stringing a racket head 24*a* is similar to that described with reference to the previous embodiment, i.e. by passing a single length of string consecutively between opposed apertures 34*a* forming the transverse length 30*a* and then threading the same or another string to form intersecting longitudinal lengths 32*a*. Additionally, a similar signal device 42*a* (not shown) can be attached to each of the respective matrices 28*a*, 28*a*' for use in the manner disclosed.

It should be appreciated that although the invention has been illustrated and described as a tennis racket, the invention can be adapted for use in other sports wherein a racket is employed to propel a projectile.

Thus, it will be seen that there is provided a racket which achieves the various objects of the invention and which is well suited to meet the conditions of practical use.

As various changes might be made in the tennis racket as above set forth, it is to be understood that all material herein described or shown in the accompanying drawings is to be interpreted as illustrative and not in a limiting sense.

Having thus described the invention, there is claimed as new and desired to be secured by Letters Patent:

1. A racket suitable for use in propelling a game projectile, the racket comprising a stem portion and a head portion, said head portion including a frame member having an inner margin defining an included area, said frame member supporting projectile propelling means within said included area for providing an impact zone to contact with the game projectile, the propelling means further including a plurality of longitudinal string lengths and a plurality of transverse string lengths forming duplicate striking matrices, said matrices being substantially coplanar respectively with a front and a rear face of the frame member and signalling means including a noise emitting element attachable to each of the respective projectile matrices, whereby deflection upon projectile impact with either matrix will result in contact between said elements to effect an audible response.

2. A racket as claimed in claim 1 wherein the signalling means includes at least two plate members, said plate members having string engagement means for resilient securement to the respective matrices.

3. A racket as claimed in claim 2 wherein each plate is provided with a noise emitting element, the spacing between said elements being selectively adjustable for contact in accordance with the magnitude of the projectile impact force.

4. A racket as claimed in claim 3 wherein the noise emitting element is threadably secured to the plate member.

5. A racket as claimed in claim 1 wherein the noise emitting element includes a half-round metallic head.

* * * * *